US012515720B2

(12) United States Patent
Schuster et al.

(10) Patent No.: US 12,515,720 B2
(45) Date of Patent: Jan. 6, 2026

(54) SIGNAL BOX CONTROLLED CREW WARNING SYSTEM

(71) Applicant: PRODES GmbH, Vienna (AT)

(72) Inventors: Wolfgang Schuster, Vienna (AT); Gottfried Schuster, Vienna (AT)

(73) Assignee: PRODES GmbH, Vienna (AT)

( * ) Notice: Subject to any disclaimer, the term of this patent is extended or adjusted under 35 U.S.C. 154(b) by 807 days.

(21) Appl. No.: 17/786,045

(22) PCT Filed: Nov. 20, 2020

(86) PCT No.: PCT/EP2020/082789

§ 371 (c)(1),
(2) Date: Jun. 16, 2022

(87) PCT Pub. No.: WO2021/121853

PCT Pub. Date: Jun. 24, 2021

(65) Prior Publication Data

US 2023/0356762 A1 Nov. 9, 2023

(30) Foreign Application Priority Data

Dec. 16, 2019 (AT) ..... A 401/2019

(51) Int. Cl.
*B61L 23/06* (2006.01)
*B61L 15/00* (2006.01)

(52) U.S. Cl.
CPC ..... *B61L 23/06* (2013.01); *B61L 15/0027* (2013.01); *B61L 2205/02* (2013.01)

(58) Field of Classification Search
CPC ... B61L 23/06; B61L 15/0027; B61L 2205/02
See application file for complete search history.

(56) References Cited

U.S. PATENT DOCUMENTS 4,584,798 A * 4/1986 Rivoire ..... B24B 27/0007 451/5
5,978,717 A 11/1999 Ebersohn et al.
(Continued)

FOREIGN PATENT DOCUMENTS

CH 714678 A1 8/2019
DE 4428868 C1 * 8/1995 ..... B61L 23/06
(Continued)

*Primary Examiner* — Jason C Smith
(74) *Attorney, Agent, or Firm* — Laurence A. Greenberg; Werner H. Stemer; Ralph E. Locher

(57) ABSTRACT

A signal-controlled crew warning system for warning people of approaching rail vehicles on an operational track located in a warning sector of a work track. The warning system includes a track-building machine for working on the work track, a positioning system for determining the position of the track-building machine, a computer-aided monitoring system for generating warning information, warning measures for generating acoustic or optical or haptic warning signals, and a radio system for wireless data transfer. The computer-aided monitoring system is configured to set boundaries of the warning sector on a basis of the current position of the track-building machine and to automatically generate warning information for the warning sector. The track-building machine has a central control unit for processing the warning information, which control unit is coupled to the computer-aided monitoring system via the radio system. The warning sector thus moves along with the track-building machine as it travels.

17 Claims, 1 Drawing Sheet

(56) References Cited

U.S. PATENT DOCUMENTS

| | | | | |
|---|---|---|---|---|
| 6,471,162 | B1 * | 10/2002 | Pace | B61L 29/32 246/294 |
| 10,774,478 | B2 * | 9/2020 | Baker | B61L 23/047 |
| 12,214,815 | B2 * | 2/2025 | Schuster | B61L 23/06 |
| 2012/0296562 | A1 | 11/2012 | Carlson et al. | |
| 2022/0324497 | A1 * | 10/2022 | Brick | B61L 27/53 |
| 2023/0356762 | A1 * | 11/2023 | Schuster | B61L 15/0027 |
| 2024/0127138 | A1 * | 4/2024 | Smith | G06Q 10/1097 |
| 2024/0343279 | A1 * | 10/2024 | Wilczek | B61L 23/34 |

FOREIGN PATENT DOCUMENTS

| | | | | |
|---|---|---|---|---|
| DE | 102006041705 | B3 * | 3/2008 | B61L 23/06 |
| DE | 102009048652 | A1 | 3/2011 | |
| DE | 102014205862 | A1 * | 10/2015 | B61L 23/06 |
| EP | 2085286 | A2 | 8/2009 | |
| EP | 3401185 | A2 * | 11/2018 | B61L 23/06 |
| EP | 3406504 | A1 | 11/2018 | |
| EP | 3459813 | A1 * | 3/2019 | |
| JP | H0848249 | A | 2/1996 | |
| JP | 2016141308 | A | 8/2016 | |
| JP | 2017185892 | A | 10/2017 | |
| KR | 1020100019148 | A | 2/2010 | |

* cited by examiner

SIGNAL BOX CONTROLLED CREW WARNING SYSTEM

FIELD AND BACKGROUND OF THE INVENTION

The invention relates to a signal box controlled crew warning system for warning persons of approaching rail vehicles on an operating track, located in a warning sector of a working track, comprising a track maintenance machine for working on the working track, a locating system for determining the position of the track maintenance machine, a computer-aided monitoring system for generating warning information, warning means for generating acoustic or visual or haptic warning signals, and a radio system for wireless data transmission. In addition, the invention relates to a method for operating the crew warning system.

Track maintenance machines are usually used for constructing and maintaining railway lines. In the process, persons (crews) often stay on the track to control machine work units or to monitor work processes. To ensure personal safety, so-called crew warning systems are used. This warns persons in the danger zone acoustically, visually and, if necessary, haptically (e.g. via vibration of a warning vest) of approaching trains. The reason for this is that usually operating tracks in use run alongside a working track.

A modern train control system (e.g. European Train Control System, ETCS) and a digital mobile radio system for railway operations (e.g. Global System for Mobile Communications—Railway, GSM-R) form important parts of a higher-level management system of railway operations (e.g. European Rail Traffic Management System, ERTMS). Such technical solutions offer possibilities for the automation of warning systems. Known signal box controlled crew warning systems (Signal Controlled Warning Systems, SCWS) use signal box information to generate warning information for crews by means of a computer-aided monitoring system.

According to prior art, crew warning systems consist of stationary and mobile devices. The stationary devices are set up next to the working track when a track construction site is set up and divide a track section into several warning sectors (warning areas). The mobile devices are carried by lookouts or are attached to a track maintenance machine located on the working track. Such a system is known, for example, from EP 2 085 286 A2. Therein, the mobile devices mounted on a track maintenance machine are set up for the automatic detection of various warning sectors. In this way, warning devices of the track maintenance machine are activated in relation to the respective warning sector.

SUMMARY OF THE INVENTION

The object of the invention is to improve a signal box controlled crew warning system of the kind mentioned above in such a way that the effort required to set up a track construction site is minimised. In addition, the safety of persons on the construction site is to be increased. Another object is to specify an optimised method for operating the crew warning system.

According to the invention, these objects are achieved by the features of the independent claims. Dependent claims indicate advantageous embodiments of the invention.

In this case, the computer-aided monitoring system is set up to define boundaries of the warning sector on the basis of a current position of the track maintenance machine and to generate warning information for the warning sector in an automated manner, with the track maintenance machine comprising a central control unit for processing the warning information, which is coupled to the computer-aided monitoring system via the radio system. Essential here is the use of the position data of the track maintenance machine to define the warning sector. In this way, the warning sector moves with the moving track maintenance machine. A transfer from warning sector to warning sector is thus no longer necessary. In addition, the central control unit for automatic processing of warning information is integrated into the track maintenance machine. The track maintenance machine thus serves as a mobile automated warning system (mobile AWS). No additional warning devices are required on the track.

In an advantageous further development, the locating system is integrated into a higher-level train control system, with the computer-aided monitoring system being set up to process information from the train control system in order to generate warning information for the warning sector. Position data generated by the train control system is used to automatically detect dangerous situations. Thus, the train control system serves as an additional source of information for generating the warning information by means of the computer-aided monitoring system.

The radio system advantageously comprises mobile radio modules of a secured mobile radio network. For example, GSM-R (Global System for Mobile Communications-Railway) or FRMCS (Future Railway Mobile Communication System) based on LTE (Long Term Evolution) and 5G (fifth-generation) are used. Both the computer-aided monitoring system and the central control unit are coupled to their own mobile radio module.

In order to be able to use the warning functions particularly efficiently, it is useful if the central control unit is connected via a data network to warning means arranged on the track maintenance machine. In this way, warning means can be easily added and harmonised with each other. In this case, the central control unit comprises a network module, in particular with a TCP/IP connection.

Another improvement provides that the central control unit is connected via the data network to an operating device arranged on the track maintenance machine for configuring the central control unit. Several operating devices can also be provided. In this case, the operating devices are set up in such a way that when one operating device is used, all other operating devices are deactivated for the duration of use.

To trigger a follow-up warning by an operator, the central control unit is advantageously connected via the data network to a triggering unit, arranged on the track maintenance machine, for a warning signal.

Further improvements result from the arrangement of mobile devices. It is useful if the central control unit is coupled via the radio system to a mobile operating device for configuring the central control unit. This operating device is also configured to temporarily block other operating devices when in use.

It is also useful to have a mobile triggering unit that is coupled to the central control unit via the radio system to activate a warning signal. In this way, a follow-up warning by lookouts on the track is possible at any time.

An advantageous further development of the invention relates to a person-specific warning. In this case, the central control unit is coupled to at least one so-called personal warning device. Such a warning device is carried by a person working on the track. It comprises a warning transmitter that emits a visual, acoustic, and/or a haptic warning signal. In particular, the warning device comprises a radio module to receive warning messages from the central control unit via the radio system. For activities to be carried out in the immediate vicinity of the machine, wired warning devices can also be used. These are coupled to the central control unit via a TCP/IP interface, for example.

For the integration of various warning system components, it is useful if the central control unit includes a so-called ERRI interface. This means that components from common manufacturers can be coupled to and used with the central control unit. The ERRI interface also provides a supply voltage for such components.

A further improvement of the invention provides that the track maintenance machine comprises a GNSS receiving device and that the GNSS receiving device is coupled to the central control unit. With this satellite locating system, the position of the track maintenance machine is continuously recorded. The central control unit transmits the position data to the computer-aided monitoring system. There, the data is either used directly to define the warning sector or first compared with data from another locating system.

In the method according to the invention for operating the described crew warning system, before warning information is generated by means of the computer-aided monitoring system, boundaries of a warning sector are defined on the basis of a current position of the track maintenance machine, with generated warning information being sent to a central control of the track maintenance machine via a radio system and with warning means being activated by means of the central control. In this way, the track maintenance machine is used as a mobile automatic warning system.

Advantageously, position data of the track maintenance machine and position data of approaching rail vehicles are derived from information of a train control system. The information from the train control system is available in a signal box and is evaluated by means of the computer-aided monitoring system to generate the warning information.

Another improvement provides that the approach of the rail vehicle is detected as an entry into an approach section defined before and after the warning sector. In particular, boundaries of corresponding approach sectors are defined based on the current position of the track maintenance machine. This means that different warning scenarios can be realised.

The function of the locating system is advantageously extended by determining current position data of the track maintenance machine by means of a GNSS receiving device arranged on the track maintenance machine, with the position data being transmitted to the computer-aided monitoring system. In addition, the use of terrestrial radio equipment along the track is useful. Specifically, reference antennas of a Differential GNSS System (DGNSS) are used to achieve a highly accurate localisation of the track maintenance machine.

BRIEF DESCRIPTION OF THE FIGURES

In the following, the invention is explained by way of example with reference to the accompanying figures. The following figures show in schematic illustrations.

DETAILED DESCRIPTION OF THE INVENTION

Figure 1:
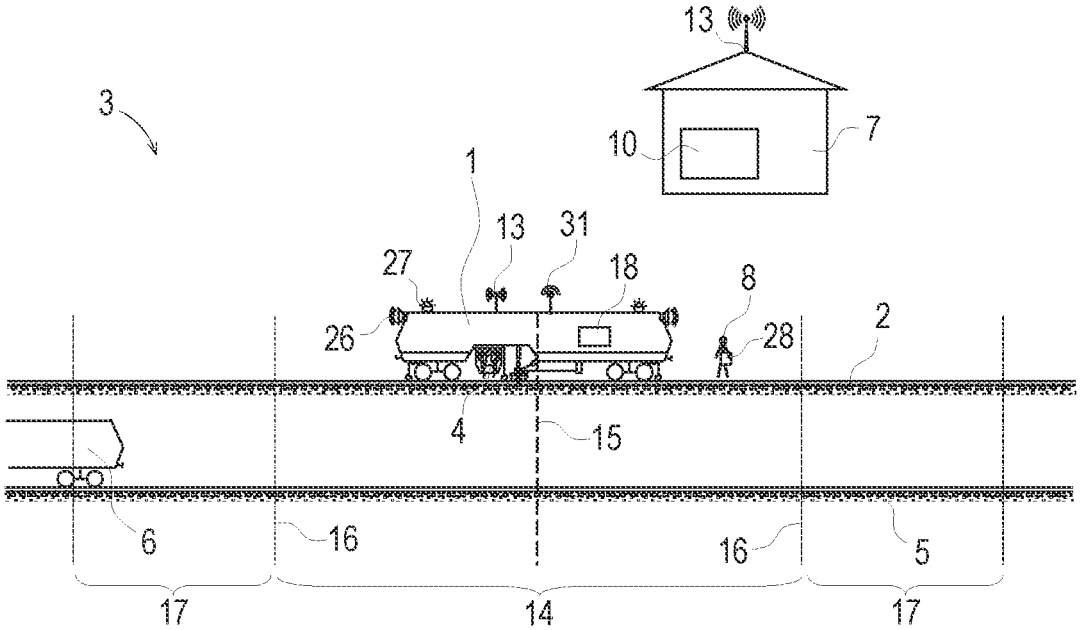
FIG. 1 Track maintenance machine on a track system

The track maintenance machine 1 shown in FIG. 1 carries out work on a working track 2 of a track system 3. This is, for example, a tamping machine, a cleaning machine, a track stabiliser, a track renewal train or the like with various work units 4. The exemplary track system 3 comprises an operating track 5, which runs next to the working track 2. While the work is being carried out, the working track 2 is closed to other rail vehicles 6. However, train traffic continues on the operating track 5. A signal box 7 is assigned to the track system 3 to control and monitor the operation of trains.

Figure 2:
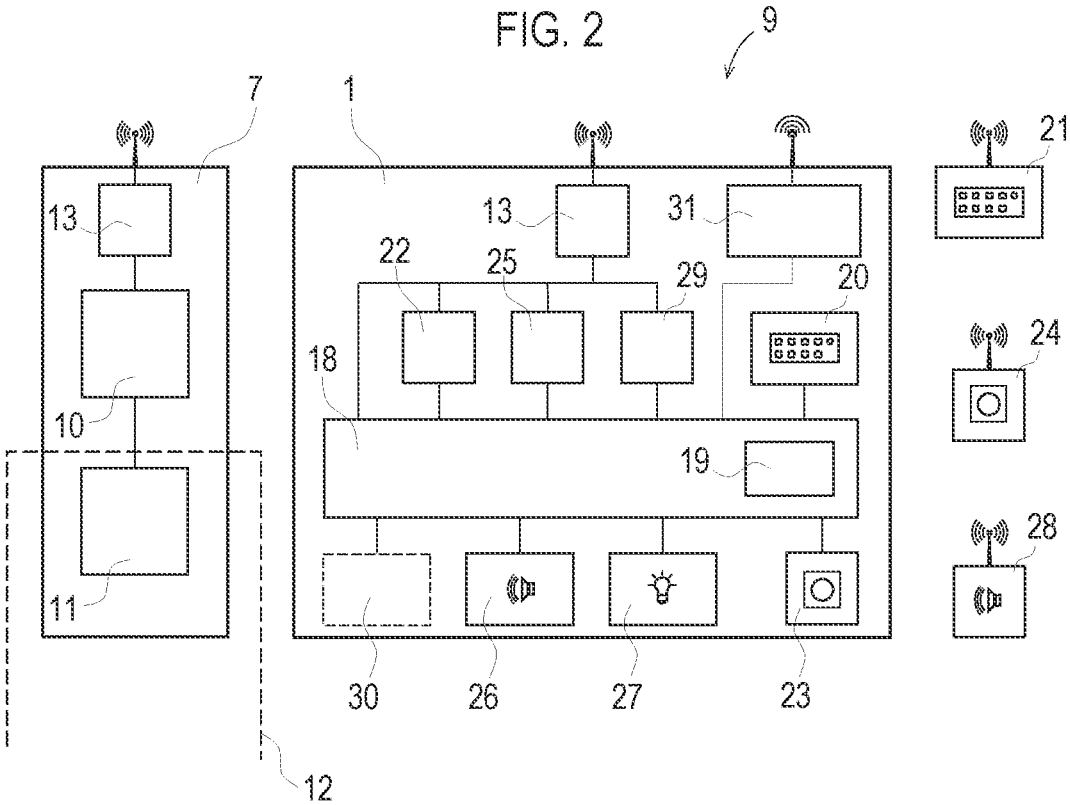
FIG. 2 Block diagram of the crew warning system

In an area around the track maintenance machine 1, there are persons 8 who are referred to as a crew. These persons 8 belong to the operating personnel of the track maintenance machine 1, work as lookouts, or are involved in the work process in some other way. In any case, there is a need to warn these persons 8 of approaching rail vehicles 6 on the operating track 5. A signal box controlled crew warning system 9 is set up for this purpose. FIG. 2 illustrates the crew warning system set-up. Such a system 9 is also called an Automatic Warning System (AWS) or Automatic Train Warning System (ATWS).

Stationary components of the crew warning system 9 are preferably arranged in the building of the signal box 7. This includes a computer-aided monitoring system 10 for generating warning information. This computer-aided monitoring system 10 acts as an AWS centre and processes position data from the track maintenance machine 1 and from approaching rail vehicles 6. In this case, the computer-aided monitoring system 10 is coupled to a railway safety system 11 (central electronic signal box system). All turnouts, signals, axle counters, track vacancy detection systems and the like are integrated into the railway safety system 11 in order to control and monitor train, shunting, and secondary movements.

Advantageously, the signal box 7 is integrated into a higher-level train control system 12, with the railway safety system 11 forming an element of this train control system 12. One example is the European Train Control System (ETCS). A locating system is integrated into the train control system 12, via which the track maintenance machine 1 and the other rail vehicles 6 continuously report their current positions. The position data is transmitted via a radio system, for example via the digital mobile radio system for railway operations (e.g. Global System for Mobile Communications—Railway, GSM-R). The signal box 7 is connected to the radio system by means of a mobile radio module 13.

According to the invention, the position data of the track maintenance machine 1 is used to define a warning sector 14 of the crew warning system 9 by means of the computer-aided monitoring system 10. As soon as another rail vehicle enters or approaches the warning sector 14, warning information is generated. The warning sector 14 moves automatically with the track maintenance machine 1 travelling along the working track.

To define the warning sector 14, a working location 15 of the track maintenance machine 1 is assumed, for example. This is known through the position data and the type of track maintenance machine 1. For example, the working location 15 is defined by tamping units of a tamping machine. Boundaries 16 of the warning sector 14 result at predetermined distances from the working location 15. These distances can be variable if the speed of an approaching rail vehicle 6 is also taken into account. Higher speeds cause an expansion of the warning sector 14, so that there is always a constant approach time from the sector boundary 16 to the working location 15. It is also useful to define approach sections 17 before and after the warning sector 14. Driving on the approach sections 17 triggers a pre-warning stage with corresponding warning information. Furthermore, the length of the track maintenance machine 1 is taken into account when defining the warning sector 14. It is also possible to define a group of several machines located on the working track 2 as a coupled track maintenance machine 1.

The generated warning information is transmitted to the track maintenance machine 1 via the radio network. For this purpose, the track maintenance machine 1 comprises a mobile radio module 13. The information is processed in a central control unit 18, which is advantageously coupled to a machine control of the track maintenance machine 1. In addition, the central control unit 18 has network interfaces (TCP/IP interface) and a power supply 19.

At least one operating device 20 is arranged on the track maintenance machine 1, which is directly connected to the central control unit 18 via a network interface. Such fixed operating devices 20 are installed where a system operator (lookout, $SiP_o$) performs safety activities within the track maintenance machine 1. A mobile operating device 21 is provided for safety work outside the track maintenance machine 1. This comprises a mobile radio module 13. To connect the mobile operating device 21, the central control unit 18 is connected to the mobile radio module 13 of the track maintenance machine 1 via an interface module 22.

As soon as one of the operating devices 20, 21 is used, the other operating devices 20, 21 are deactivated for the duration of use. The operating devices 20, 21 can also be used to configure the central control unit. For example, country-specific warning signals (RO1, RO2, RO3) are set.

A fixed triggering unit 23 (e.g. manual alarm button) for triggering a warning signal is connected to the central control unit 18. A mobile triggering unit 24 is coupled to the central control unit 18 via the mobile radio modules 13 and an additional interface module 25. The triggering units 23, 24 are intended for follow-up warnings in the event of danger. A warning signal is usually triggered by other lookouts inside and outside the track maintenance machine 1.

To generate acoustic warning signals, acoustic warning means 26 (AWM) including power supply are arranged on the track maintenance machine 1 and connected to the central control unit 18 via a respective network connection. Specifically, the acoustic warning means 26 are mounted within hearing range of the persons 8 working on the track 2, 5. To reduce noise emissions, a targeted activation of the acoustic warning means 26 is useful. In this way, warnings are given selectively where work is being done. Noise sources from the track maintenance machine 1 are also taken into account. The acoustic warning means 26 are set so that they are 3 dB(A) louder than the machine 1 and can be safely perceived.

To emit optical warning signals, optical warning means 27 (OWM) including power supply are arranged and connected to the central control unit 18 via a network connection. The optical warning means are mounted on the track maintenance machine 1 in the field of vision of the persons 8 working on the track 2, 5.

In addition, it is useful to equip each person 8 working on the track 2, 5 with a personal warning device 28. Separate interface modules 29 are provided for connecting such personal warning devices 28 to the central control unit 18. Each personal warning device 28 comprises at least one warning means 26, 27. Wired personal warning devices 28 may be located at fixed workstations in the track maintenance machine 1. Mobile personal warning devices 28 include a mobile radio module 13 for connection to the radio system.

In a useful further development, the functions of the personal warning device 28, the mobile operating device 21, and the mobile triggering unit 24 are integrated into one mobile device.

For the integration of components of an existing warning system, an ERRI interface box 30 including power supply is advantageously arranged.

Another useful addition is a GNSS receiving device 31 arranged on the track maintenance machine 1. This captures current GNSS position data of the track maintenance machine 1 and transmits it to the central control unit 18. The radio system transmits the data to the signal box 7, where it is processed by the computer-aided monitoring system 10. Specifically, the GNSS position data can be used to define the warning sector or to check the plausibility of existing position data.

The described crew warning system 9 has different operating modes. In a "securing" operating mode, the central control unit 18 triggers a stop function of another rail vehicle 6 via the signal box 7 if there is no acknowledgement by a lookout in the event of a warning signal. For example, after a warning signal has been triggered, there are 30 seconds to clear a danger point and to perform an acknowledgement by means of operating device 20, 21. To emit a warning signal, for example, the optical warning means 24 of the track maintenance machine 1 are activated. The warning means 24 are deactivated again when the rail vehicle 6 has completely passed the working location 15.

In a "warning" operating mode, a warning signal is emitted for a predetermined duration (e.g. 30 seconds) before a rail vehicle 6 enters the warning sector 14. The specified approach sections 17 are adapted to the speed of the rail vehicle 1.

The coupling and execution of the central control 18 with the machine control of the track maintenance machine 1 ensures that a safe state is brought about in the event of a fault in accordance with the "fail-safe" function, safety integrity level 3. Any fault of a safety-relevant component of the warning system 9 is detected by the central control 18. Subsequently, a fault alarm (RO3) is automatically triggered, and the machine 1 is brought into a safe state. This includes stopping the machine 1 and the work units 14.

The invention claimed is:

1. A signal box-controlled crew warning system for warning persons of approaching rail vehicles on an operating track, and disposed in a warning sector of a working track, the signal box-controlled crew warning system comprising:

a computer-aided monitoring system for generating warning information;

a radio system for wireless data transmission;

a track maintenance machine for working on the working track and having a central controller for processing the warning information and being coupled to said computer-aided monitoring system via said radio system;

a locating system for determining a position of said track maintenance machine;

warning means for generating acoustic, visual or haptic warning signals; and said computer-aided monitoring system being set up to define boundaries of the warning sector on a basis of a current position of said track maintenance machine such that the warning sector moves automatically with the track maintenance machine travelling along the working track and to generate the warning information for the warning sector in an automated manner as soon as another rail vehicle enters or approaches the automatically moving warning sector.

2. The signal box-controlled crew warning system according to claim 1, wherein:

said locating system is integrated into a higher-level train control system; and said computer-aided monitoring system is set up to process information from said higher-level train control system to generate the warning information for the warning sector.

3. The signal box-controlled crew warning system according to claim 1, wherein said radio system contains mobile radio modules of a secured mobile radio network.

4. The signal box-controlled crew warning system according to claim 1, wherein said central controller is connected via a data network to said warning means disposed on said track maintenance machine.

5. The signal box-controlled crew warning system according to claim 4, further comprising an operating device disposed on said track maintenance machine for configuring said central controller, wherein said central controller is connected via the data network to said operating device.

6. The signal box-controlled crew warning system according to claim 4, further comprising a triggering unit disposed on said track maintenance machine, said central controller is connected via the data network to said triggering unit for triggering a warning signal.

7. The signal box-controlled crew warning system according to claim 1, further comprising a mobile operating device, said central controller is coupled via said radio system to said mobile operating device for configuring said central controller.

8. The signal box-controlled crew warning system according to claim 1, further comprising a mobile triggering unit, said central controller is coupled via said radio system to said mobile triggering unit for triggering a warning signal.

9. The signal box-controlled crew warning system according to claim 1, further comprising a personal warning device, said central controller is coupled to said personal warning device.

10. The signal box-controlled crew warning system according to claim 1, wherein said central controller has an European Rail Research Institute (ERRI) interface.

11. The signal box-controlled crew warning system according to claim 1, wherein said track maintenance machine has a global navigation satellite system (GNSS) receiving device and said GNSS receiving device is coupled to said central controller.

12. A method for using the crew warning system according to claim 1, which further comprises:

carrying out track work on the working track by means of the track maintenance machine, generating the warning information by means of the computer-aided monitoring system when a rail vehicle is approaching on the operating track, wherein before the warning information is generated by means of the computer-aided monitoring system, the boundaries of the warning sector are defined on the basis of the current position of the track maintenance machine such that the warning sector moves automatically with the track maintenance machine travelling along the working track; and transmitting the warning information to the central controller of the track maintenance machine via the radio system in an automated manner as soon as another rail vehicle enters or approaches the automatically moving warning sector, and in that the warning means are activated by means of the central controller.

13. The method according to claim 12, which further comprises deriving position data of the track maintenance machine and position data of approaching rail vehicles from information of a train control system.

14. The method according to claim 12, which further comprises detecting an approach of the rail vehicle as an entry into an approach section defined before and after the warning sector.

15. The method according to claim 12, which further comprises determining current position data of the track maintenance machine by means of a global navigation satellite system (GNSS) receiving device disposed on the track maintenance machine, and in that position data is transmitted to the computer-aided monitoring system.

16. The signal box-controlled crew warning system according to claim 1, wherein said computer-aided monitoring system is set up to define exactly one warning sector for said track maintenance machine.

17. The signal box-controlled crew warning system according to claim 1, wherein the warning sector is determined depending on a length of said track maintenance machine.

* * * * *